United States Patent [19]

Yamaya et al.

[11] Patent Number: 5,018,429

[45] Date of Patent: May 28, 1991

[54] WAVEFORM GENERATING APPARATUS FOR AN ELECTRONIC MUSICAL INSTRUMENT USING FILTERED COMPONENTS OF A WAVEFORM

[75] Inventors: Hideo Yamaya, Akishima; Akio Iba, Tokorozawa, both of Japan

[73] Assignee: Casio Computer Co., Ltd., Tokyo, Japan

[21] Appl. No.: 332,803

[22] Filed: Apr. 3, 1989

[30] Foreign Application Priority Data

Apr. 7, 1988 [JP] Japan ..... 63-84138
Apr. 7, 1988 [JP] Japan ..... 63-84139

[51] Int. Cl.[5] ..... G10H 1/12; G10H 3/14; G10H 7/00

[52] U.S. Cl. ..... 84/622; 84/736; 84/DIG. 9

[58] Field of Search ..... 84/622, 623, 661, 673, 84/699, 700, 736, DIG. 9

[56] References Cited

U.S. PATENT DOCUMENTS

| | | | |
|---|---|---|---|
| 3,767,833 | 10/1973 | Noble et al. | 84/673 |
| 3,902,396 | 9/1975 | Hiyoshi | 84/700 X |
| 4,023,455 | 5/1977 | Peterson | 84/DIG. 9 |
| 4,106,384 | 8/1978 | Whittington et al. | 84/DIG. 9 |
| 4,738,179 | 4/1988 | Suzuki | 84/DIG. 9 |

*Primary Examiner*—Stanley J. Witkowski
*Attorney, Agent, or Firm*—Frishauf, Holtz, Goodman & Woodward

[57] ABSTRACT

Waveform data is read out from a memory which stores the waveform data at a rate corresponding to a designated pitch. The readout data is supplied to digital filters, and two or more different filtering operations are executed in the digital filters. Two or more waveform data obtained as a filtering result are synthesized at a rate determined in response to a breath input signal output from a breath sensor, and the synthesized data is output as a musical tone waveform signal. The filter performs the filtering operation while a cut-off frequency is changed in response to the breath input signal.

17 Claims, 6 Drawing Sheets

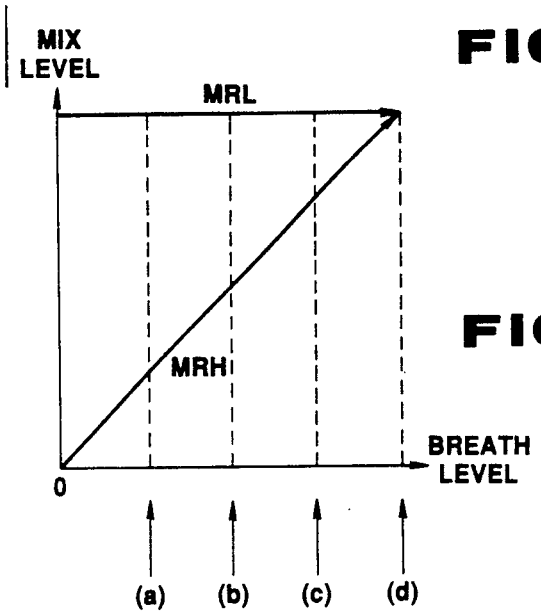
FIG. 5
FIG. 6A
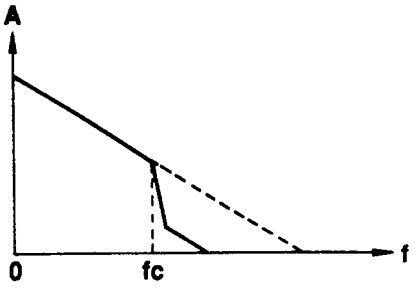
FIG. 6B
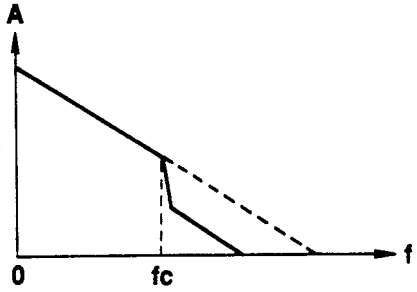
FIG. 6C
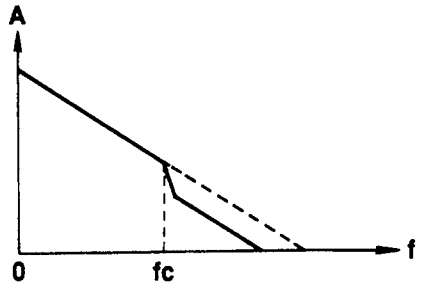
FIG. 6D
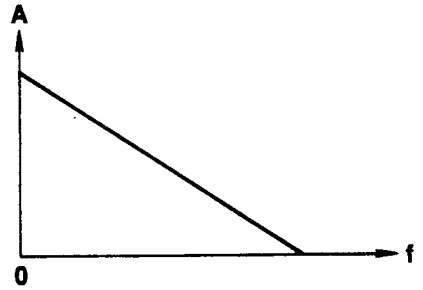

FIG. 8A
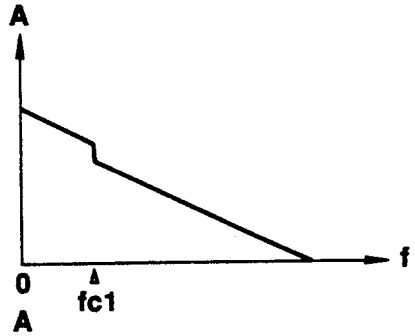
FIG. 8B
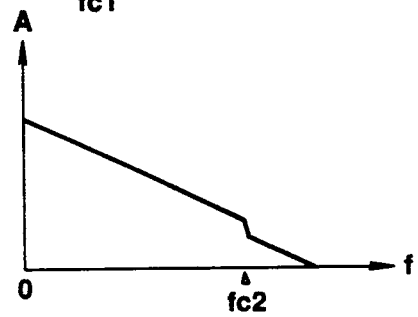
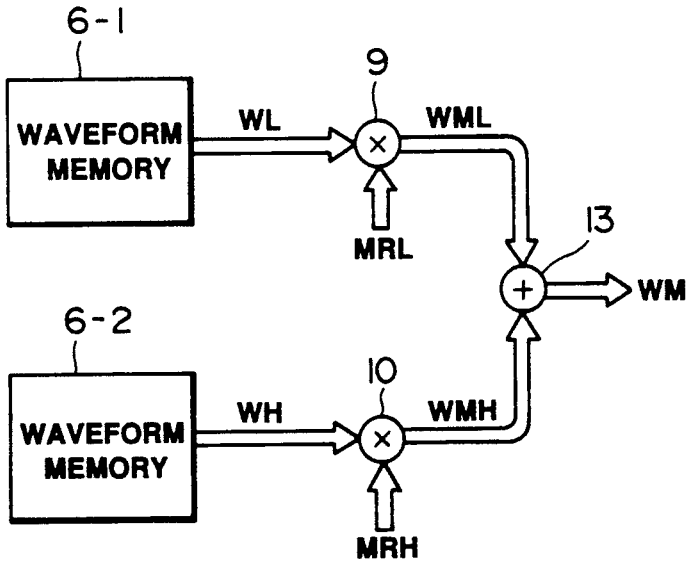
FIG. 10

WAVEFORM GENERATING APPARATUS FOR AN ELECTRONIC MUSICAL INSTRUMENT USING FILTERED COMPONENTS OF A WAVEFORM

BACKGROUND OF THE INVENTION

1. Field of the Invention

The present invention relates to an electronic musical instrument for reading out a waveform signal as a sound source waveform signal from a waveform memory means, and for changing the harmonic configuration of the sound source waveform signal in response to an external control signal, thereby changing the timbre of a musical tone to be generated.

2. Description of the Related Art

An electronic musical instrument for reading out a waveform signal from a waveform memory means to obtain a sound source waveform signal is conventionally known.

In such conventional electronic musical instruments, however, a VCF (voltage controlled filter), a DCF (digitally controlled filter or digital filter), a VCA (voltage controlled amplifier), a DCA (digitally controlled amplifier), or the like is used to change the tone quality such as timbre or volume of a musical tone to be generated. Therefore, only the timbre is changed by changing a cut-off frequency or a bandpass center frequency in a harmonic spectrum of a sound source waveform signal, and hence the harmonic spectrum of an original sound source waveform signal is not largely changed, and its timbre is not sufficiently changed.

SUMMARY OF THE INVENTION

The present invention has been made to solve the above problems, and has as its object to provide an electronic musical instrument which can easily realize various changes of a timbre in response to an external control signal generated by musical performance.

More specifically, according to one aspect of the present invention, there is provided an electronic musical instrument in which waveform data is read out from a memory means which digitally stores a sound signal as the waveform data, the waveform data is properly filtered by a filter means, the output filtered waveform data from the filter means is synthesized by a synthesizing means, and the conditions and characteristics of filtering by the filter means or the synthesis ratio of a plurality of waveform data filtered in a plurality of divided frequency bands in the synthesizing means are changed by a controlling means in response to an external control signal generated by performance so as to variably control a harmonic spectrum of the synthesized waveform data.

According to the above-mentioned aspect of the present invention, the filter means is required. However, in order to further simplify the circuit arrangement, the following arrangement can be employed.

More specifically, according to another aspect of the present invention, there is provided an electronic musical instrument, in which a plurality of items of waveform data are read out from a memory means which stores a plurality of items of waveform data obtained by pre-filtering one sound signal in different conditions or divided frequency bands, the readout items of waveform data are synthesized by a synthesizing means, and the synthesis ratio of the synthesizing means is changed by a controlling means in response to an external control signal generated by performance so as to variably control the harmonic spectrum of the synthesized waveform data.

BRIEF DESCRIPTION OF THE DRAWINGS

The other objects and characteristics of the present invention are to be understood by one skilled in the art according to the description of the preferred embodiments of the present invention with reference to the accompanying drawings, in which:

FIG. 5 is a graph of level control data showing a change in the level control data controlled by a breath level of a breath input;

FIGS. 6A, 6B, 6C, and 6D are graphs of the spectra of the synthesized waveform signals which change in correspondence with the breath level;

FIGS. 8A and 8B are graphs showing the spectra of the synthesized signal when filter coefficient control data is changed;

FIG. 10 is a block diagram showing the synthesizing circuit of the waveform signals, serving as a main part of the embodiment in FIG. 9.

DETAILED DESCRIPTION OF THE PREFERRED EMBODIMENTS

An electronic musical instrument according to first and second embodiments of the present invention will be described hereinafter with reference to the accompanying drawings.

First Embodiment

Figure 1:
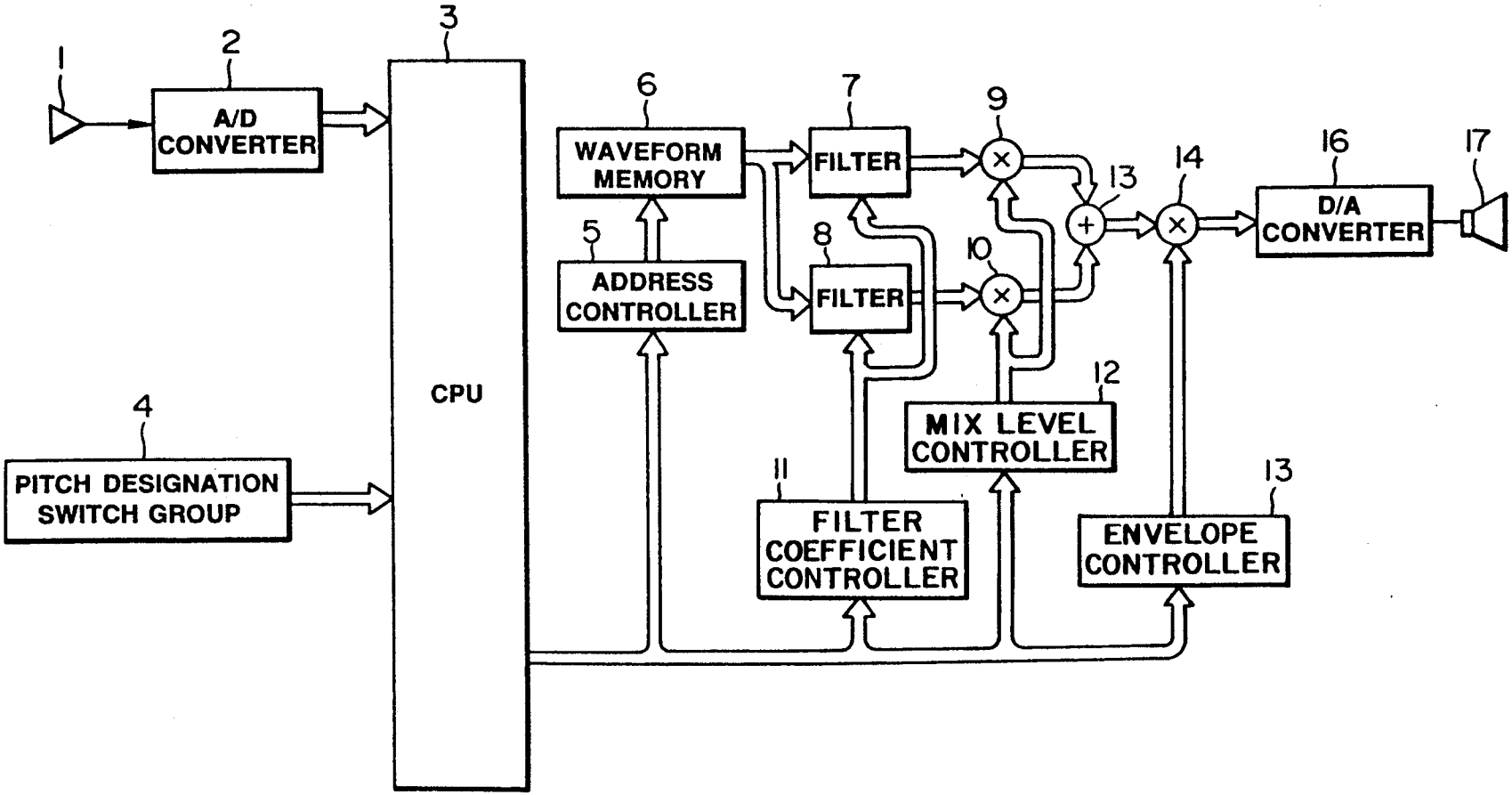
FIG. 1 is a block diagram showing an entire arrangement according to a first embodiment in which the present invention is applied to an electronic wind instrument.

FIG. 1 is a block diagram according to a first embodiment, showing an entire circuit arrangement when the present invention is applied to an electronic wind instrument for producing a desired musical tone based on a breath input by a breath operation of a player. Referring to FIG. 1, a breath input detected by a breath sensor 1 in accordance with performance (a breath operation in this case) of a player is converted into an analog voltage signal, and thereafter the voltage signal is converted into a digital signal by an A/D converter 2. The converted signal is input to a central processing unit (CPU) 3 which includes a microprocessor. The CPU 3 receives pitch designation data output by a depressing operation of a pitch designation switch group 4. The CPU 3 outputs a control signal in accordance with the breath input and the pitch designation data to an address controller 5 as an external control signal. An address signal is supplied from the address controller 5 to a waveform memory 6 (in this case, a ROM) which stores a sound source waveform signal in the form of, e.g., PCM (Pulse Code Modulation) data. The contents stored in a designated area in the waveform memory 6 are read out in response to the address signal, at a rate corresponding to a pitch of a musical tone to be generated, i.e., the above-mentioned pitch designation data.

The readout waveform signal is supplied to filters 7 and 8, wherein the waveform signal is filtered in two divided frequency bands. The output two filtered signals are respectively supplied to multipliers 9 and 10. The filters 7 and 8 are digital filters in this embodiment, such as those disclosed in, e.g., U.S. Pat. Nos. 4,422,156, 4,467,440, and 4,489,391, or a filter constructed by a DSP (Digital Signal Processor) can be used. The filters 7 and 8 receive filter coefficient control data from a filter coefficient controller 11. The filter coefficient controller 11 is controlled by a control signal from the CPU 3. The control signal from the CPU 3 corresponds to a breath input sensed by the breath sensor 1, and is output from the CPU 3 as an external control signal generated by performance. A filter coefficient table memory (not shown) can be used as the filter coefficient controller 11 to which an address signal corresponding to the breath input is supplied to read out a corresponding filter coefficient control data. The multipliers 9 and 10 receive level control data from a mix level controller 12 controlled in response to the control signal from the CPU 3. The supplied level control data is multiplied with the waveform signals respectively supplied from the filters 7 and 8, and the multiplied outputs are supplied to an adder 13. In addition, the waveform signal supplied from the adder 13 to the multiplier 14 is multiplied with envelope control data from an envelope controller 15 controlled in response to the control signal corresponding to the breath input and output from the CPU 3. The multiplied output is converted into an analog signal by a D/A converter 16, and is supplied to a sound system 17 including an amplifier, a loudspeaker, and the like, to produce a musical sound.

An operation of this embodiment will be described below.

Figure 2:
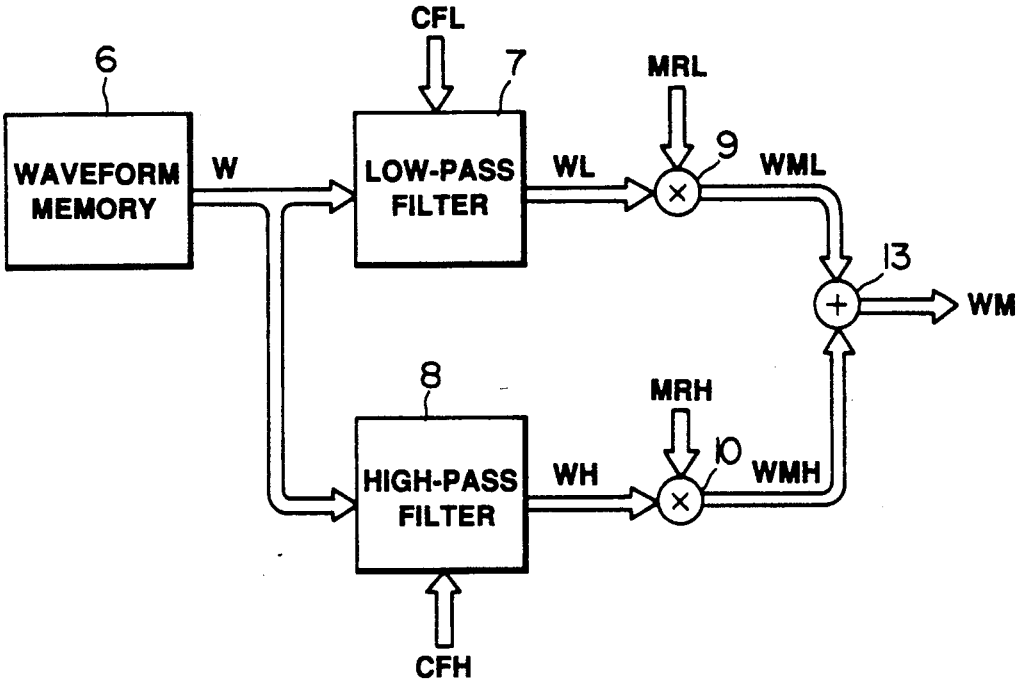
FIG. 2 is a block diagram showing an arrangement of a circuit serving as a main part in the FIG. 1, for obtaining two signals having different frequency contents by filtering in divided frequency bands and synthesizing them.

FIG. 2 is a block diagram showing a main circuit concerned with the division and synthesis of the waveform signals in frequency bands in FIG. 1. The same reference numerals in FIG. 2 denote the parts having the same function as those in FIG. 1. Referring to FIG. 2, a waveform signal W read out from the waveform memory 6 is subjected to frequency band division into waveform signals WL and WH by the filter 7 serving as a low-pass filter and the filter 8 serving as a high-pass filter, respectively. In the filter 7, its lower cut-off frequency is variably controlled by filter coefficient control data CFL output from the filter coefficient controller 11 shown in FIG. 1. Similarly, in the filter 8, its upper cut-off frequency is variably controlled by filter coefficient control data CFH. Note that, in the following descriptions, the low-pass cut-off frequency of the filter 7 is the same as the high-pass cut-off frequency of the filter 8, i.e., a cut-off frequency fc. The low-pass and high-pass cut-off frequencies may be different from each other, as a matter of course.

Figure 3A:
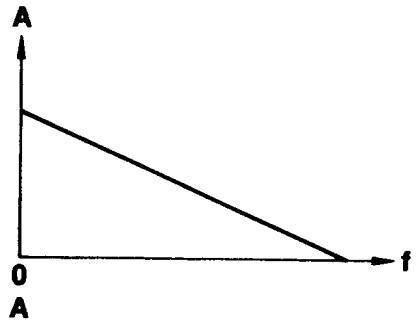
FIGS. 3A, 3B, and 3C are graphs showing spectra when the waveform signals are filtered by divided frequency bands.
Figure 3B:
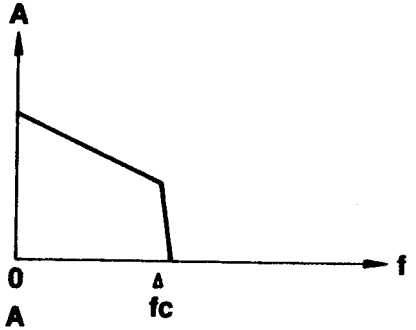
Figure 3C:
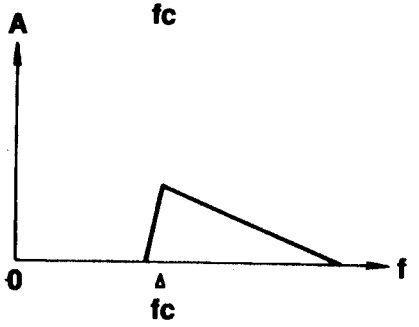

FIGS. 3A, 3B, and 3C are graphs showing states wherein the spectrum of the waveform signal W is subjected to spectral division into two frequency bands by the filters 7 and 8. Referring to FIGS. 3A, 3B, and 3C, each axis of abscissa represents a frequency f, and each axis of ordinate represents an amplitude A. FIG. 3A shows the spectral characteristics of the waveform signal W read out from the waveform memory 6. FIG. 3B shows the spectral characteristics of the waveform signal WL obtained by attenuating the waveform signal W with respect to upper cut-off frequency fc, i.e., eliminating the high-frequency components. FIG. 3C shows the spectral characteristics of the waveform signal WH obtained by attenuating the waveform signal W with respect to lower cut-off frequency fc, i.e., eliminating the low-frequency components. Both the spectra are largely different from the spectrum of the original waveform signal W, and it is apparent that the spectra of their harmonic tones are largely changed.

The waveform signal WL is multiplied with mix level control data MRL from the mix level controller 12 shown in FIG. 1 by the multiplier 9, to obtain a level controlled waveform signal WML. Similarly, the waveform signal WH is multiplied with mix level control data MRH from the mix level controller 12 by the multiplier 10, and a level controlled waveform signal WMH is obtained. These waveform signals WML and WMH are added to each other by the adder 13, and mixed, i.e., synthesized, to obtain a synthesized waveform signal WM.

Figure 4A:
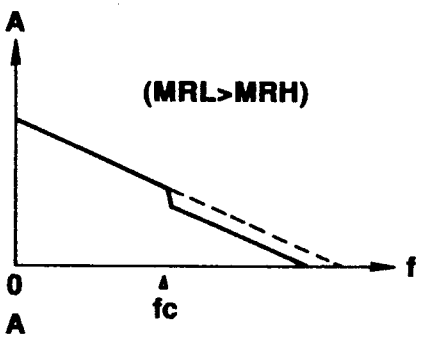
FIGS. 4A and 4B are graphs showing the spectra of the synthesized waveform signals.
Figure 4B:
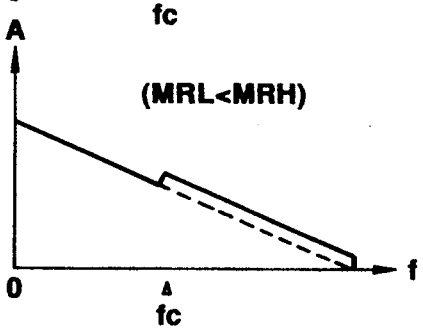

FIGS. 4A and 4B are graphs showing the spectral characteristics wherein the harmonic contents of the resynthesized waveform signal WM are changed in correspondence with the mix level control data MRL and MRH. Referring to FIGS. 4A and 4B, each axis of abscissa represents a frequency f, and each axis of ordinate represents an amplitude A. FIG. 4A shows a case wherein MRL>MRH, i.e., a case wherein the value of the mix level control data MRL is larger than that of the mix level control data MRH. The level of the harmonics in a frequency range higher than the cut-off frequency fc in the spectral characteristics of the re-synthesized waveform signal WM is relatively lower as compared with the spectrum of the original waveform signal W. On the contrary, FIG. 4B is a graph showing the spectral characteristics of the re-synthesized waveform signal WM when MRL<MRH. In FIG. 4B, the level of the harmonics in a frequency range higher than the cut-off frequency fc is relatively higher as compared with the spectrum of the original waveform signal W.

Figure 7:
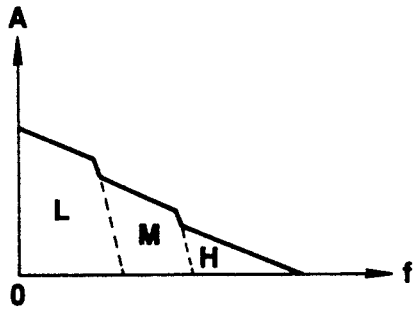
FIG. 7 is a graph showing the spectrum of the synthesized signal when a sound signal is filtered in three frequency bands, and three filtered output signals are synthesized again.

In the electronic wind instrument according to this embodiment, a breath input by performance (breath input operation) performed by a player is sensed by the breath sensor 1. FIG. 5 is a graph of level control data characteristics showing a state wherein the level control data MRL and MRH are changed in accordance with the breath level of the sensed breath input. Referring to FIG. 5, the abscissa represents a breath level of digital breath data obtained from the A/D converter 2, and the ordinate represents an example of the mix level between the mix level control data MRL and MRH supplied to the multipliers 9 and 10 from the mix level controller 12, and multiplied with the waveform signals WL and WH supplied through the filters 7 and 8, respectively. Note that the various changes of the relationship between the breath level and mix level can be made, as a matter of course. One pattern may be selected from a plurality of patterns stored in the mix level controller 12 in FIG. 1. FIGS. 6A, 6B, 6C, and 6D are graphs of the spectral characteristics of the synthesized waveform signal WM obtained by adding at the adder 13 the waveform signals WML and WMH respectively multiplied with the mix level control data MRL and MRH corresponding to breath level points (a), (b), (c) and (d) in FIG. 5. More specifically, in this case, even if the breath level is changed, the value of the mix level control data MRL with respect to the waveform signal WL output from the filter 7 after the low-pass filtering is always constant. However, as the breath level is increased from the point (a) through the points (b), (c) and (d) in the order named, the value of the mix level control data MRH with respect to the waveform signal WH output from the filter 8 after the high-pass filtering is linearly changed from the level 0 to the level of the MRL. As shown in FIG. 6A, at the breath level point (a) of FIG. 5, the synthesized waveform signal WM has spectral characteristics wherein the amplitude A of the harmonic component in a frequency range higher than the cut-off frequency fc is relatively largely decreased. More specifically, the synthesized waveform signal WM having an extremely small number of harmonic components in a frequency range higher than the cut-off frequency fc can be obtained. Similarly, as shown in FIGS. 6B and 6C, at the breath level points (b) and (c), the amplitudes A of the spectra are relatively gradually increased in a frequency range higher than the cut-off frequency fc. Since MRL=MRH at the breath level (d), the spectral characteristics shown in FIG. 6D are the same as those of the original waveform signal W which is not passed through the filters 7 and 8. Thus, a resynthesis ratio upon resynthesis is changed in response to an external control signal generated by performance i.e., the level of the breath input, and the amplitude level of the harmonic component included in the frequency range higher than the cut-off frequency is changed. More specifically, when the level of the breath input is small, high harmonic components are cut, and the amplitude levels of the high harmonic components are increased as the level of the breath input is increased. Therefore, the timbre of the musical tone to be produced is changed in accordance with the level of the breath input. More specifically the timbre is changed so that the level of the high harmonic components is increased as the level of the breath input is increased. In the same manner as in the case of a conventional acoustic instrument such as a saxophone, when a breath input is increased, a timbre which includes a large number of harmonic components is obtained. Assume that, at this time, the number of filters for dividing the frequency band of the original waveform signal W is not two but three (e.g., a low-pass filter, a band-pass filter, and a high-pass filter), the waveform signal W read out from the waveform memory 6 is filtered in three divided frequency bands L (low), M (middle), and H (high), and the synthesis ratios of the above bands in the adder 13 are variably controlled in response to the breath input. In this case, as shown in FIG. 7, delicate and natural timbre variation can be obtained as compared with the case wherein the waveform signal W is divided into two frequency bands L and H.

FIGS. 8A and 8B are graphs showing the spectral characteristics of the synthesized waveform signal WM when the items of filter coefficient control data CFL and CFH is changed in accordance with the level of the breath input without changing the levels of the mix level control data MRL and MRH, the waveform signal W is subjected to spectrum division and the divided waveform signals WL and WH are synthesized by the adder 13. Referring to FIGS. 8A and 8B, each abscissa represents a frequency (f), and each ordinate represents an amplitude (A). FIG. 8A is a graph showing the spectral characteristics of the synthesized waveform signal WM synthesized when MRL>MRH. As compared with the spectrum of the original waveform signal W, the level of the harmonic components in a frequency range higher than a cut-off frequency fc1 is suppressed to be small. In FIG. 8B, the level of the harmonic components in a frequency range higher than a cut-off frequency fc2 (fc1≠fc2) is also suppressed to be small. Therefore, the spectrum of the waveform signal W is changed in correspondence with the level of the breath input, so that the harmonic is changed. Therefore, the timbre of a musical tone to be produced can be changed.

When the synthesis ratio is controlled so that the spectrum is arbitrarily changed instead of the control in synthesis ratio for realizing a timbre change similar to that in a conventional acoustic instrument, quite new original timbre can be obtained. In the same manner as in the case wherein the timbre of a musical sound signal is changed by a graphic equalizer, a timbre changing effect can be obtained so that the amplitude level of an arbitrary frequency band has a peak value. In this case, the center frequency of a bandpass filter is changed according to musical performance, e.g., breath input, so that an interesting timbre changing effect can be obtained. Other modes of filtering can be employed, and various cut-off frequencies and types of filter can be selected.

Note that, although a breath input is used as an external control signal for controlling a synthesis ratio in the above embodiment, a lip input which corresponds to a force generated when a player bites a mouthpiece may be used in place of the breath input.

In the above embodiment, the present invention is applied to an electronic wind instrument. When the present invention is applied to an electronic stringed instrument, a picking input i.e., a picking level of strings is used for controlling the characteristic of the filtering or the synthesis ratio of the filtered wave-form signals. When the present invention is applied to an electronic keyboard instrument, a key touching input is used for the same. Furthermore, in electronic musical instruments of various types, a pitch designation input for continuously changing the pitch can be used as an external control signal generated by performance for variably controlling the characteristics of the division filters or the synthesis ratio of a divided waveform signal.

In the above embodiment, digital filters are used for filtering the waveform signal W read out from the waveform memory 6 which stores digital data such as a PCM representation data in a plurality of frequency bands. However, when the readout waveform signal W is converted into an analog signal by a D/A converter, the signal can be filtered in a plurality of frequency bands not using a digital filter but using a normal VCF (voltage controlled filter). The filtered signals are controlled at proper levels and synthesized but using a digital multiplier and digital adder but using VCA (voltage controlled amplifier) and analog adder, so that the same effect can be obtained as in the case wherein the digital filters are used.

Waveform data to be stored in the waveform memory 6 is not limited to data of all the waveforms obtained by the PCM scheme, and the waveform data having one or proper number periods can be stored. In addition, the data format of waveforms is not limited to the PCM data, and data encoded by DPCM, ADPCM, or the like can be used.

The waveform memory 6 need not be provided inside the main body of the electronic musical instrument, but a ROM card, an IC card, a magnetic disk, or the like can be used to externally supply waveform data. In this case, an internal RAM may temporarily store external waveform data, or the waveform data can be directly used out from the external memory.

In the above embodiment, the synthesized waveform signal WM resynthesized by the adder 13 is supplied to the multiplier 14, and an envelope is controlled in accordance with envelope control data from the envelope controller 15 to change the volume of a musical tone to be produced. However, the envelope control operation is not always required. In particular, when the waveform signal W read out from the waveform memory 6 already has an envelope, the envelope control operation can be omitted.

As has been described above, according to an embodiment of the present invention, one waveform data read out from a memory means digitally storing a sound signal is filtered by a filter means in a plurality of modes, and the resultant plurality of items of waveform data are synthesized by a synthesizing means to obtain a musical tone. The synthesis ratio of the above synthesizing means is variably controlled in response to an output from a performance means, or a filtering operation of the filter means is variably controlled in response to an output from the performance means. Therefore, in accordance with the operation of a player, fine and complicated timbre variation can be realized. The timbre of the original tone can be easily and effectively changed as if a graphic equalizer is used.

One waveform data read out from the memory means digitally storing a sound signal as waveform data is filtered in a plurality of divided frequency bands by the filter means, and the items of the divided and filtered waveform data are synthesized. Then, the characteristics of the filter means or the synthesis ratio upon synthesis, or both of them are changed by a control means in response to an external control signal generated by performance of a player, and the harmonic spectrum of the synthesized waveform data is variably controlled. Therefore, a plurality of the waveform data having spectra different from that of the original waveform data are combined, and a new musical tone waveform signal can be obtained. For this reason, an electronic musical instrument which can easily realize fine and complicated timbre variation in accordance with the performance of the player can be effectively obtained.

Second Embodiment

A second embodiment according to the present invention will be described hereinafter with reference to FIGS. 9 and 10.

Figure 9:
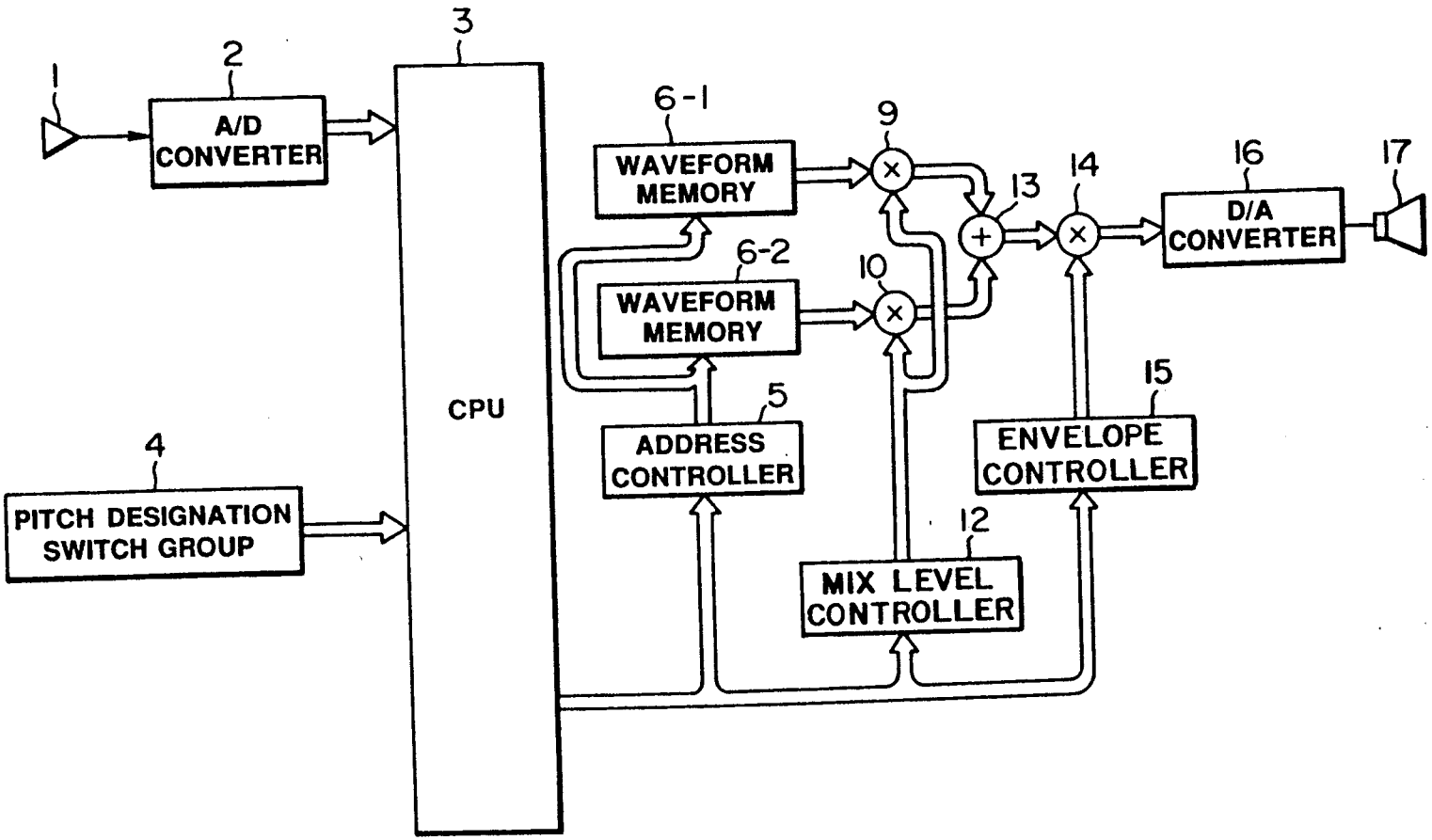
FIG. 9 is a block diagram showing an entire arrangement according to a second embodiment of the present invention.

FIGS. 9 and 10 respectively correspond to FIGS. 1 and 2 referred upon a description of the first embodiment. The same reference numerals in FIGS. 9 and 10 denote the same parts as in FIGS. 1 and 2, and a description thereof is omitted.

More specifically, an address signal is supplied from an address controller 5 to waveform memories 6-1 and 6-2 (both are ROMs, in this case) which respectively store sound source waveform signals divided into two frequency ranges in the form of PCM data, for example. The contents stored in designated areas in the waveform memories 6-1 and 6-2 are read out in response to the address signal at a rate corresponding to the pitch of a musical tone to be produced, i.e., the pitch designation data. Then, the readout waveform signals are respectively supplied to multipliers 9 and 10.

Referring to FIG. 10, waveform signals WL and WH read out from the waveform memories 6-1 and 6-2 are supplied to the multipliers 9 and 10, respectively.

The waveform memory 6-1 prestores waveform data obtained by converting (filtering) the spectrum of a single sound source waveform signal (e.g., a sampling waveform signal) W as shown in FIG. 3A used upon a description of the first embodiment into a waveform signal WL having spectral characteristics obtained by cutting higher harmonic components in a frequency range higher than a cut-off frequency fc, as shown in FIG. 3B. The waveform memory 6-2 prestores waveform data obtained by converting (filtering) the waveform signal W into a waveform signal WH having spectral characteristics obtained by cutting lower harmonic components in a frequency range lower than the cut-off frequency fc, as shown in FIG. 3C.

The waveform signal WL is multiplied with mix level control data MRL from a mix level controller 12 shown in FIG. 9 by the multiplier 9, and a waveform signal WML, the level of which is controlled for mixing, is obtained. Similarly, the waveform signal WH is multiplied with mix level control data MRH from the mix level controller 12 by the multiplier 10, and a waveform signal WMH, the level of which is controlled for mixing, is obtained. These waveform signals WML and WMH are added to each other by an adder 13, and a mixed, i.e., resynthesized waveform signal WM is obtained.

As a result, also in the second embodiment, the spectral characteristics of the resynthesized waveform signal WM are as shown in FIGS. 4A and 4B.

In this case, as shown in, e.g., FIG. 5, a mix level is controlled in accordance with the mix level control data MRL and MRH.

Note that various changes of the relationship between the breath level and mix level can be made, as has been described above. One pattern can be selected from a plurality of patterns stored in the mix level controller 12. In this case, FIGS. 6A, 6B, 6C, and 6D are graphs of the spectral characteristics of the synthesized waveform signal WM corresponding to breath level points (a), (b), (c), and (d) in FIG. 5.

Thus, the synthesis ratio when the waveform signals WL and WH respectively read out from the waveform memories 6-1 and 6-2, are synthesized by the adder 13 is changed in response to the level of a breath input, i.e., an external control signal generated by performance, and the amplitude level of the harmonic components included in a frequency range higher than a cut-off frequency is changed. More specifically, when the level of the breath input is small, higher harmonic components are cut, and the amplitude levels of the higher harmonic components are gradually increased as the level of the breath input is increased. Therefore, the timbre of a musical tone to be produced is changed in accordance with the level of the breath input, and the timbre is changed so that the levels of the higher harmonic components are increased as the level of the breath input is increased. As in the case of a conventional acoustic instrument such as a saxophone, a timbre which includes a large number of harmonic components is obtained when a breath input is increased. In this case, the original waveform signal W may be divided into three frequency band signals, e.g., low (L), middle (M), and high (H), and the divided signals can be respectively stored in three waveform memories. The readout waveform signals WL, WM, and WH are respectively multiplied with the mix level control data MRL, MRM, and MRH from the mix level controller 12 by the multipliers. Thereafter, items of the multiplied data are added and synthesized to each other by an adder 13 to obtain a synthesized signal WM. In this case, as shown in FIG. 7, fine timbre variation can be realized as compared with the case wherein the data stored in two waveform memories are used.

In the second embodiment, when the synthesis ratio is controlled so that the spectrum is arbitrarily changed instead of the control in synthesis ratio for realizing a timbre change similar to that in a conventional acoustic instrument, quite new original timbre can be obtained. In the same manner as in the case wherein the timbre of a musical sound signal is changed by a graphic equalizer, a timbre changing effect can be obtained so that the amplitude level of an arbitrary frequency band has a peak value.

Note that, although a breath input is used as an external control signal for controlling a synthesis ratio in the above embodiment, a lip input which corresponds to a force generated when a player bites a mouthpiece may be used in place of the breath input.

In the above embodiment, the present invention is applied to an electronic wind instrument. When the present invention is applied to an electronic stringed instrument, a picking input i.e., a picking level of strings is used for controlling the synthesis ratio of the read out waveform signals. When the present invention is applied to an electronic keyboard instrument, a key touching input is used for the same. Furthermore, in electronic musical instruments of the various types, a pitch designation input which continuously changes can be used as an external control signal generated by performance for variably controlling the synthesis ratio of the output waveform signal. In addition, various modes of the filtering for obtaining the prefiltered waveform signals can be employed. Low-, high-, bandpass filters, and the like can be selected, and the kind, type, and cut-off frequency of the filters can be variously selected.

Waveform data to be stored in the waveform memories 6-1 and 6-2 are not limited to all the waveform data obtained by the PCM scheme, and the waveform data having one or proper number of periods can be stored. In addition, the data format of waveforms is not limited to the PCM data, and data encoded by DPCM, ADPCM, or the like can be used.

The waveform memories 6-1 and 6-2 need not be provided inside the main body of the electronic instrument, but a ROM card, an IC card, a magnetic disk, or the like can be used to externally supply waveform data. In this case, an internal RAM may store temporarily external waveform data, or the waveform data may be directly read out from the external memory.

In the above embodiment, the synthesized waveform signal WM resynthesized by the adder 13 is supplied to the multiplier 14, and an envelope is controlled in accordance with envelope control data from the envelope controller 15 to change the volume of a musical tone to be produced. However, the envelope control operation is not always required. In particular, when the waveform signal W read out from the waveform memories 6-1 and 6-2 already has an envelope, the envelope control operation can be omitted.

As has been described above, according to the second embodiment of the present invention, a plurality of items of waveform data are read out from a memory means which stores the plurality of items of waveform data obtained by filtering one sound signal in different modes or different frequency band, and the filtered waveform data is synthesized by a synthesizing means. Upon the synthesis of these waveform data, the synthesis ratio is changed in response to an external control signal generated by performance, so that the harmonic spectrum of the synthesized waveform data is variably controlled. Therefore, an electronic musical instrument having a simple configuration, which can obtain various timbres while continuously changing the timbres, and can easily realize fine and complicated timbre variation in accordance with performance of a player, can be obtained.

What is claimed is:

1. An electronic musical instrument comprising:

memory means for digitally storing waveform data representative of a particular sound;

filter means including means coupled to said memory means for filtering the stored waveform data, which has been read out from said memory means, in different filtering conditions, and means for outputting a plurality of different filtered waveform data corresponding to the stored waveform data which has been filtered in said different filtering conditions;

synthesizing means for synthesizing the plurality of different filtered waveform data obtained from said filter means to generate a synthesized musical tone signal;

musical performing means for manually playing a musical piece; and variable control means for variably controlling a synthesis ratio at which the plurality of different filtered waveform data are synthesized by said synthesizing means in response to an output from said musical performing means.

2. An instrument according to claim 1, wherein said musical performing means comprises breath sensor means for sensing a breath input and generating a corresponding breath input signal; and said variable control means variably controls the synthesis ratio in accordance with an amount of the breath input signal received from said breath sensor means.

3. An instrument according to claim 1, wherein said filter means comprises cut-off frequency variable digital filter means.

4. An electronic musical instrument comprising:

memory means for digitally storing waveform data representative of a particular sound;

filter means including means coupled to said memory means for filtering the stored waveform data, which has been read out from said memory means, in different filtering modes, and means for outputting a plurality of different filtered waveform data corresponding to the stored waveform data which has been filtered in said different filtering modes;

synthesizing means for synthesizing the plurality of different filtered waveform data obtained from said filter means to generate a synthesized musical tone signal;

musical performing means for manually playing a musical piece; and variable control means for variably controlling a filtering operation of said filter means in response to an output from said musical performing means.

5. An instrument according to claim 4, wherein said musical performing means comprises breath sensor means for sensing a breath input and generating a corresponding breath input signal; and said variable control means variably controls the filtering operation of said filter means in accordance with the amount of the breath input signal received from said breath sensor means.

6. An instrument according to claim 4, wherein said variable control means varies a cut-off frequency of filtering by said filter means in response to an output from said musical performing means.

7. An instrument according to claim 4, wherein said variable control means varies a bandpass center frequency of bandpass filtering by said filter means in response to an output from said musical performing means.

8. An instrument according to claim 4, wherein said filter means comprises cut-off frequency variable digital filter means.

9. An electronic musical instrument comprising:

memory means for digitally storing waveform data representative of a particular sound;

filter means including means coupled to said memory means for filtering the stored waveform data, which has been read out from said memory means, in a plurality of divided filtering frequency bands, and means for outputting a plurality of different filtered waveform data corresponding to the stored waveform data which has been filtered in said divided frequency bands;

synthesizing means for synthesizing the plurality of different filtered waveform data obtained from said filter means at a synthesis ratio to generate a synthesized waveform data; and variable control means for changing at least one of a plurality of filtering characteristics of said filter means and said synthesis ratio of the plurality of different filtered waveform data by said synthesizing means in response to a control signal generated by a manually performed musical piece so as to variably control a harmonic overtone spectrum of said synthesized waveform data obtained from said synthesizing means.

10. An instrument according to claim 9, further comprising a musical performing means which includes a breath sensor means for sensing a breath input and generating a corresponding breath input signal, and said variable control means variably controls a filtering operation of said filter means in accordance with an amount of the breath input signal received from said breath sensor means.

11. An instrument according to claim 9, wherein said variable control means changes a cut-off frequency of filtering by said filter means.

12. An instrument according to claim 9, wherein said variable control means changes a bandpass center frequency of bandpass filtering by said filter means.

13. An instrument according to claim 9, wherein said filter means comprises cut-off frequency variable digital filter means.

14. An electronic musical instrument comprising:

memory means for storing a plurality of waveform data obtained by filtering a single sound signal in a plurality of different modes;

synthesizing means for synthesizing the plurality of waveform data read out from said memory means;

musical performing means for manually playing a musical piece; and controlling means for variably controlling a synthesis ratio at which the plurality of waveform data read out from said memory means are synthesized by said synthesizing means in response to an output of said musical performing means.

15. An instrument according to claim 14, wherein said musical performing means comprises breath sensor means for sensing a breath input and generating a corresponding breath input signal, and said controlling means variably controls the synthesis ratio in accordance with an amount of the breath input signal received from said breath sensor means.

16. An electronic musical instrument comprising:

memory means for storing a plurality of waveform data obtained by filtering a single sound signal in a plurality of divided frequency bands;

synthesizing means for synthesizing at a synthesis ratio the plurality of waveform data read out from said memory means; and controlling means for variably controlling a harmonic overtone spectrum of a synthesized waveform data received from said synthesizing means and obtained by changing said synthesis ratio of said synthesizing means in response to an external control signal generated by manual performance of a musical piece.

17. An instrument according to claim 16, further comprising a breath sensor means for generating said external control signal in accordance with an amount of a breath input supplied to said breath sensor means.

* * * * *